US008050008B2

(12) United States Patent
Suzuki

(10) Patent No.: US 8,050,008 B2
(45) Date of Patent: Nov. 1, 2011

(54) RELAY DEVICE

(75) Inventor: Hirohisa Suzuki, Nishio (JP)

(73) Assignee: Anden Co., Ltd., Anjo (JP)

( * ) Notice: Subject to any disclaimer, the term of this patent is extended or adjusted under 35 U.S.C. 154(b) by 302 days.

(21) Appl. No.: 12/540,697

(22) Filed: Aug. 13, 2009

(65) Prior Publication Data

US 2010/0046133 A1 Feb. 25, 2010

(30) Foreign Application Priority Data

Aug. 20, 2008 (JP) ..... 2008-211731

(51) Int. Cl.
*H01H 47/26* (2006.01)

(52) U.S. Cl. ..... 361/161; 361/191; 335/159

(58) Field of Classification Search ..... None
See application file for complete search history.

(56) References Cited

U.S. PATENT DOCUMENTS 6,414,576 B1 * 7/2002 Nakamura et al. ..... 335/83
6,686,821 B2 * 2/2004 Suzuki ..... 335/128
7,061,351 B2 * 6/2006 Suzuki et al. ..... 335/78
7,203,073 B2 * 4/2007 Kawakita et al. ..... 361/775
7,262,950 B2 8/2007 Suzuki et al.
2005/0135040 A1 6/2005 Suzuki et al.

FOREIGN PATENT DOCUMENTS

JP 2005-142256 6/2005

* cited by examiner

*Primary Examiner* — Stephen W Jackson
*Assistant Examiner* — Terrence Willoughby
(74) *Attorney, Agent, or Firm* — Nixon & Vanderhye PC

(57) ABSTRACT

A relay device includes mechanical relays, a first bus bar, a second bus bar, and a relay drive circuit. The relay includes a coil, a moving contact whose position changes according to whether the coil is energized, a load terminal conductive to the contact and connected to the first bar, and a coil terminal connected to the coil and second bar. The first bar includes a loading circuit. A current flows to an external load through the loading circuit opened/closed when the position of the contact changes. The second bar includes a coil circuit through which the coil is energized. The drive circuit is packaged on the second bar and opens/closes the coil circuit based on an operation signal. The first and second bars are stacked at predetermined intervals. The relays are between the first and second bars.

8 Claims, 8 Drawing Sheets

RELAY DEVICE

CROSS REFERENCE TO RELATED APPLICATION

This application is based on and incorporates herein by reference Japanese Patent Application No. 2008-211731 filed on Aug. 20, 2008.

BACKGROUND OF THE INVENTION

1. Field of the Invention

The present invention relates to a relay device having more than one mechanical relay.

2. Description of Related Art

According to a conventional relay device described in Japanese Patent No. 4070481, mechanical relays are packaged on a bus bar. A loading circuit for passing an electric current through an external load and a coil circuit for passing an electric current through a coil of the mechanical relay are formed on this bus bar.

According to a conventional relay device described in JP-A-2005-142256, mechanical relays are packaged on a bus bar, and a control circuit for controlling energization of a coil of the mechanical relay is packaged on a printed board. A part of the bus bar is bent into many tabs and an end of the tab is connected to the printed board, so that the bus bar and the printed board are electrically connected.

However, the conventional relay device described in Japanese Patent No. 4070481 needs to use a bus bar having a thickness in accordance with a great current flowing through the loading circuit. On the other hand, an electric current flowing through the coil circuit is small. Accordingly, the coil circuit needs to be as thin as possible to decrease a space used by the coil circuit. Nevertheless, the working of the bus bar becomes difficult when the coil circuit is made thin.

In the conventional relay device described in JP-A-2005-142256, the tab connecting the bus bar and the printed board needs to be formed, and a bending process is necessary to form the tab.

SUMMARY OF THE INVENTION

The present invention addresses the above disadvantages. Thus, it is an objective of the present invention to make it easy to work on a bus bar, and to render a tab unnecessary, in a relay device having mechanical relays.

To achieve the objective of the present invention, there is provided a relay device including a plurality of mechanical relays, a first bus bar, a second bus bar, and a relay drive circuit. Each of the plurality of mechanical relays includes a coil, a moving contact, a load terminal, and a coil terminal. A position of the moving contact changes in accordance with whether or not the coil is energized. The load terminal is conductive to the moving contact. The coil terminal is connected to the coil. The first bus bar includes a loading circuit. An electric current flows to an external load through the loading circuit. The loading circuit is opened and closed as a result of the change of the position of the moving contact. The second bus bar includes a coil circuit through which the coil is energized. The relay drive circuit is packaged on the second bus bar and configured to open and close the coil circuit based on an operation signal. The first bus bar and the second bus bar are stacked at predetermined intervals. The plurality of mechanical relays is located between the first bus bar and the second bus bar. The load terminal is connected to the first bus bar. The coil terminal is connected to the second bus bar.

To achieve the objective of the present invention, there is also provided a relay device including a plurality of mechanical relays, a first bus bar, a second bus bar, a plurality of semiconductor relays, a first relay drive circuit, and a second relay drive circuit. Each of the plurality of mechanical relays includes a coil, a moving contact, a load terminal, and a coil terminal. A position of the moving contact changes in accordance with whether or not the coil is energized. The load terminal is conductive to the moving contact. The coil terminal is connected to the coil. The first bus bar includes a relay loading circuit. An electric current flows to an external load through the relay loading circuit. The relay loading circuit is opened and closed as a result of the change of the position of the moving contact. The second bus bar includes a semiconductor relay loading circuit and a coil circuit. The coil is energized through the coil circuit. Each of the plurality of semiconductor relays opens and closes the semiconductor relay loading circuit. An electric current flows to an external load through the semiconductor relay loading circuit. The first relay drive circuit is configured to open and close the coil circuit based on an operation signal. The second relay drive circuit is configured to control the plurality of semiconductor relays based on the operation signal. The first relay drive circuit, the plurality of semiconductor relays, and the second relay drive circuit are packaged on the second bus bar. The first bus bar and the second bus bar are stacked at predetermined intervals. The plurality of mechanical relays is located between the first bus bar and the second bus bar. The load terminal is connected to the first bus bar. The coil terminal is connected to the second bus bar.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the invention is described below with reference to the accompanying drawings.

Figure 1:
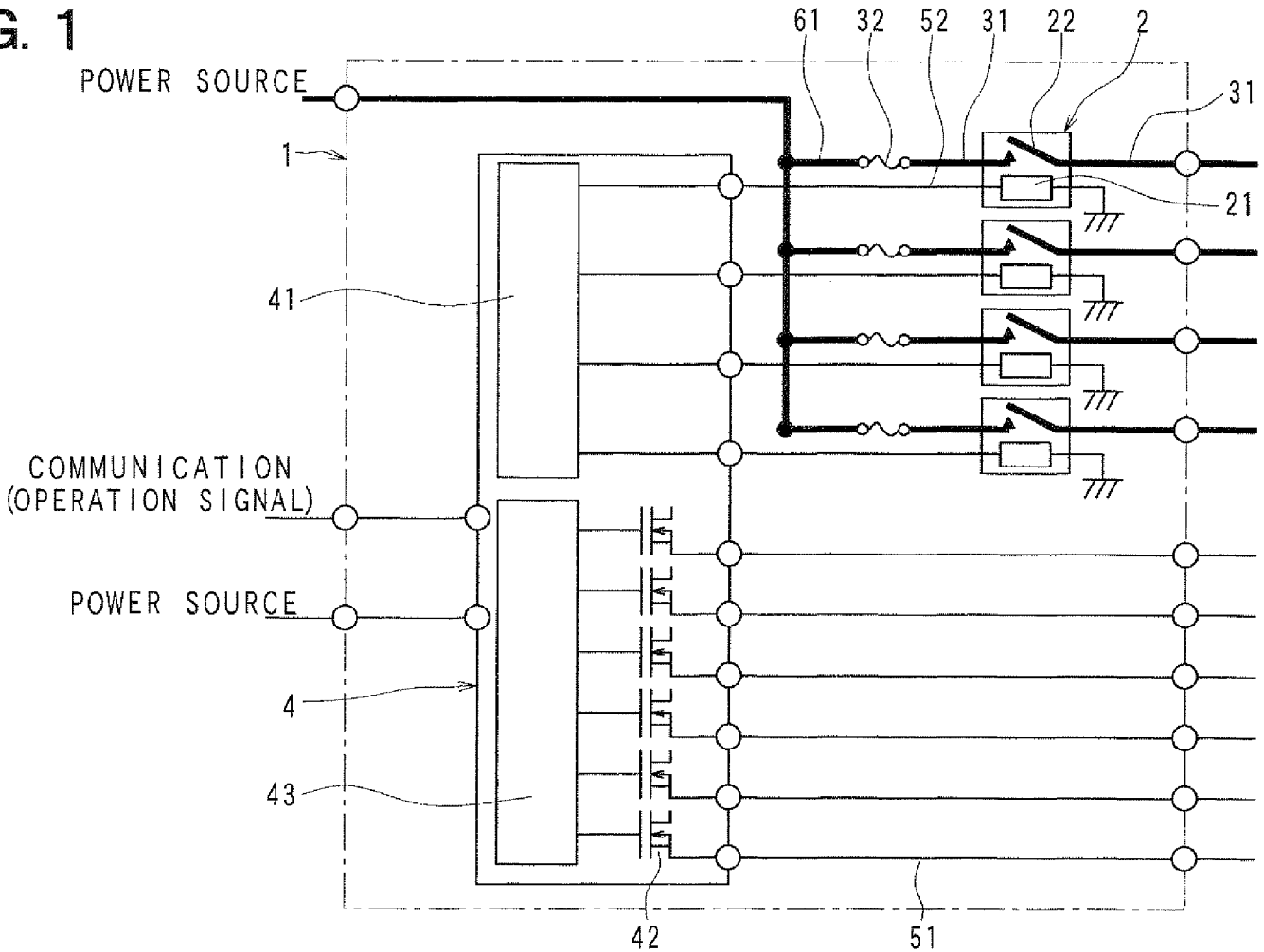
FIG. 1 is a diagram illustrating a circuit configuration of a relay device in accordance with an embodiment of the invention.

As shown in FIG. 1, a relay device 1 includes mechanical relays 2 which open and close a relay loading circuit 31 for passing an electric current through an external load as a result of a change of a position of a moving contact 22 in accordance with the presence or absence of energization of a coil 21, and an intelligent module 4. The relay loading circuit 31 and the intelligent module 4 are connected to a power source installed in a vehicle (not shown). The relay loading circuit 31 includes a fuse 32 which melts when an excess current is generated.

The intelligent module 4 includes a first relay drive circuit 41 which controls actuation of the mechanical relay 2, semiconductor relays 42 which open and close a semiconductor relay loading circuit 51 for passing an electric current through an external load and are made of, for example, a metal-oxide semiconductor field-effect transistor (MOSFET), and a second relay drive circuit 43 which controls actuation of the semiconductor relays 42 based on an operation signal transmitted via communication. In addition, the first relay drive circuit 41 controls actuation of the mechanical relay 2 by opening and closing a coil circuit 52 for passing an electric current through the coil 21 based on the operation signal transmitted via communication.

Figure 2:
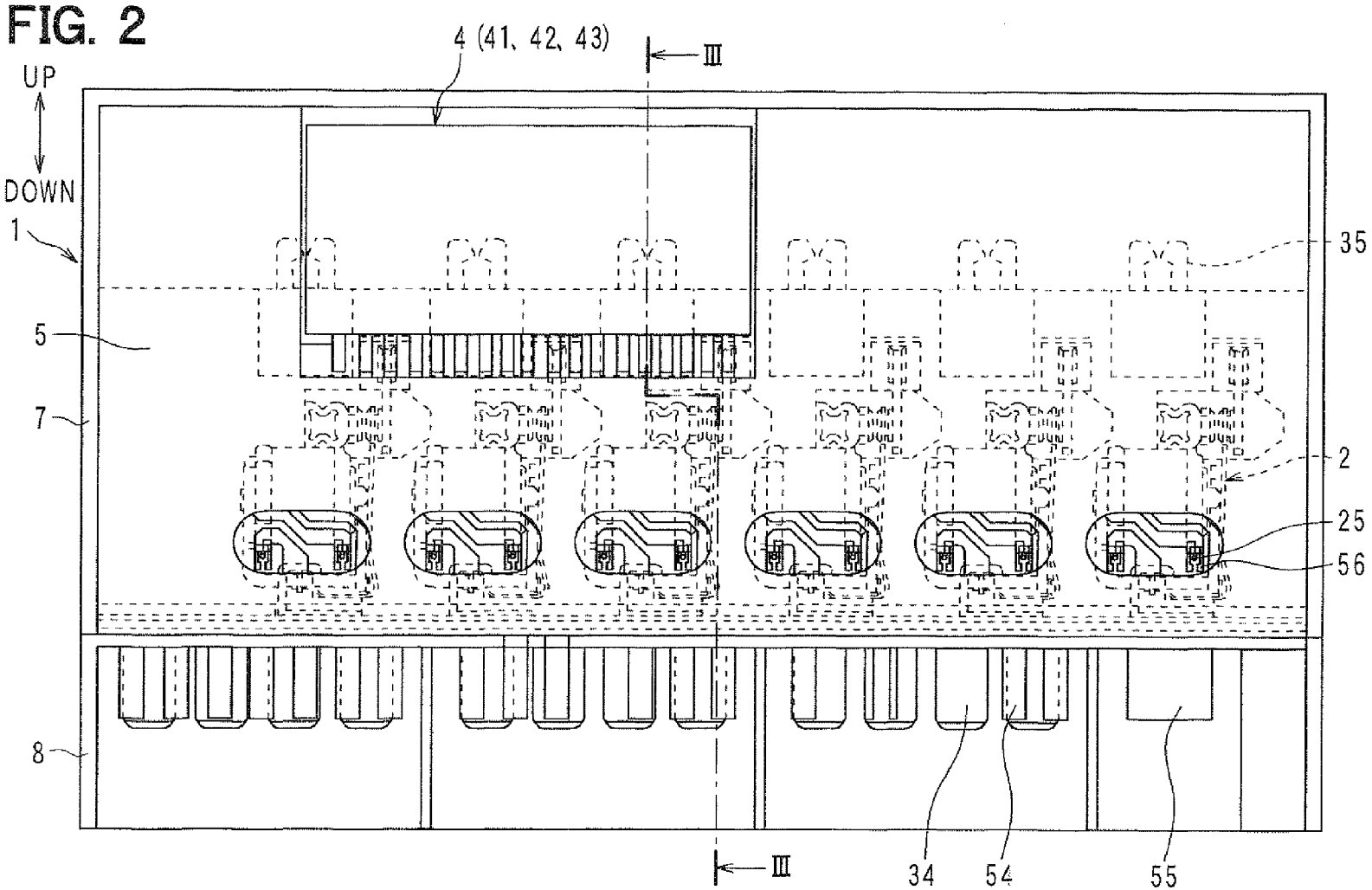
FIG. 2 is a front view illustrating the relay device in accordance with the embodiment.

FIG. 2 is shown with front surfaces of a case 7 and a connector housing 8 removed to simplify configuration of the relay device 1. Up-down arrows in FIG. 2 indicates an upward-downward (vertical) direction when the relay device 1 is installed in the vehicle.

Figure 3:
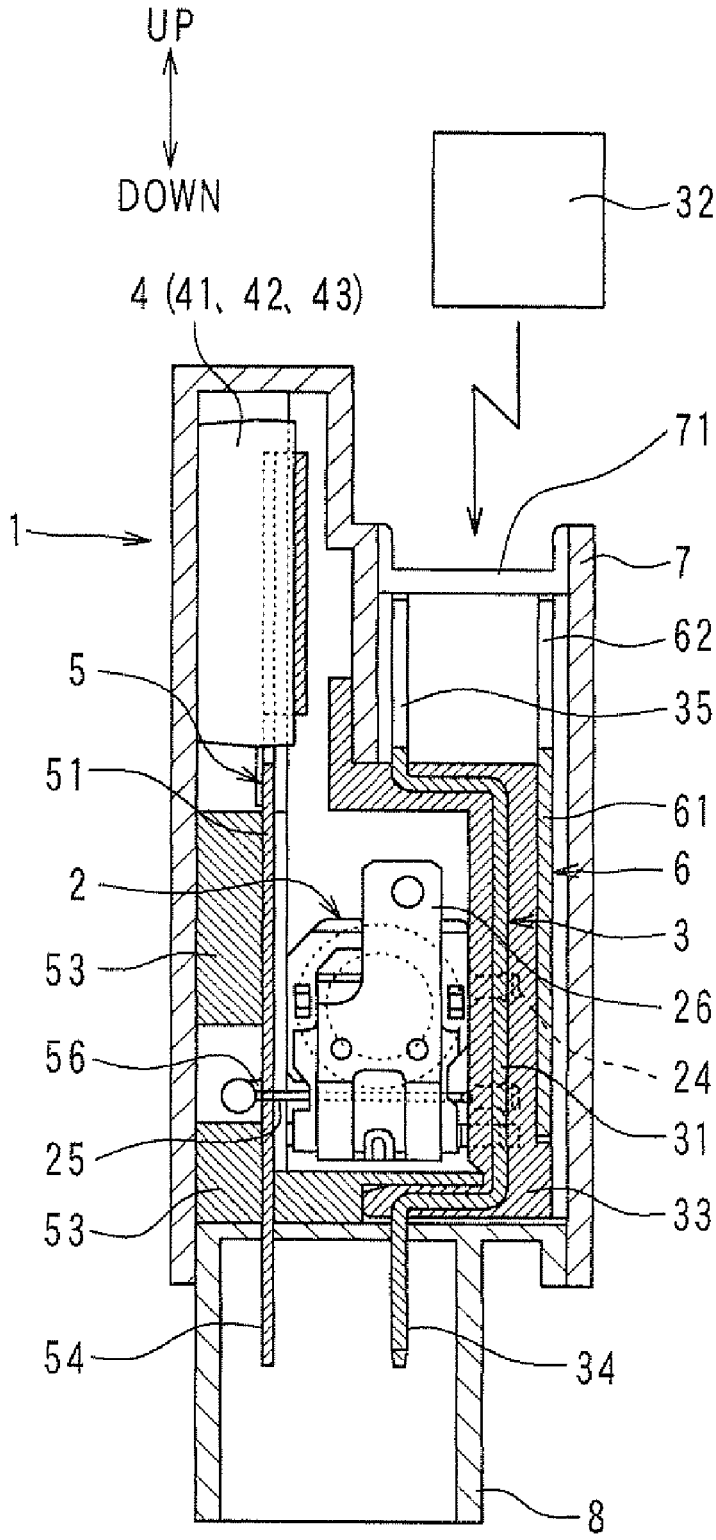
FIG. 3 is a sectional view taken along a line III-III in FIG. 2.

As shown in FIG. 2 and FIG. 3, the relay device 1 forms the relay loading circuit 31, and includes a first bus bar 3 on which the mechanical relay 2 is mounted. A plate material made of copper based alloy is pressed (more specifically, stamped and bent) to have a predetermined shape and is then resin-molded into the first bus bar 3. A predetermined portion of the first bus bar 3 is covered with a mold layer 33. The first bus bar 3 has two-way fuse terminals 35 (see FIG. 4) each of which holding the fuse 32 therebetween.

The relay device 1 includes a second bus bar 5 which forms the semiconductor relay loading circuit 51 and the coil circuit 52. A plate material made of copper based alloy is pressed (more specifically, stamped and bent) to have a predetermined shape and is then resin-molded into the second bus bar 5. A predetermined portion of the first bus bar 3 is covered with a mold layer 53.

The relay device 1 forms a fuse power source circuit 61, and has a fuse power source bus bar 6 connected to the power source of the vehicle. The fuse power source bus bar 6 is formed by pressing a plate material made of copper based alloy to have a predetermined shape. The fuse power source bus bar 6 has two-way fuse terminals 62 each of which holding the fuse 32 therebetween, and includes a connector terminal (not shown) which is connected to a power source side connector terminal (i.e., connector terminal connected to the power source of the vehicle).

The first bus bar 3, the second bus bar 5, and the fuse power source bus bar 6 are arranged in a stacking manner at predetermined intervals with the first bus bar 3 located between the bus bars 5, 6. The mechanical relays 2 are disposed between the first bus bar 3 and the second bus bar 5, and the intelligent module 4 is packaged on the second bus bar 5.

The mechanical relays 2 is shifted from the intelligent module 4 in an up-down direction so that the mechanical relays 2 and the intelligent module 4 do not overlap when the relay device 1 is viewed in a stacking direction of the first bus bar 3, the second bus bar 5, and the fuse power source bus bar 6. More specifically, the mechanical relays 2 are located below the intelligent module 4.

The first bus bar 3, the second bus bar 5, the fuse power source bus bar 6, the mechanical relays 2, and the intelligent module 4 are accommodated in a space defined by the case 7 made of resin and the connector housing 8 made of resin.

An opening 71 for attaching and detaching the fuse 32 is formed at an upper portion of the case 7. The plate-like fuse 32 is inserted into the case 7 through the opening 71. Accordingly, one end of the plate-like fuse 32 is held between the two-way fuse terminal 35 of the first bus bar 3 and the other end of the plate-like fuse 32 is held between the two-way fuse terminal 62 of the fuse power source bus bar 6. As a result, the relay loading circuit 31 and the fuse power source circuit 61 are connected.

Figure 4:
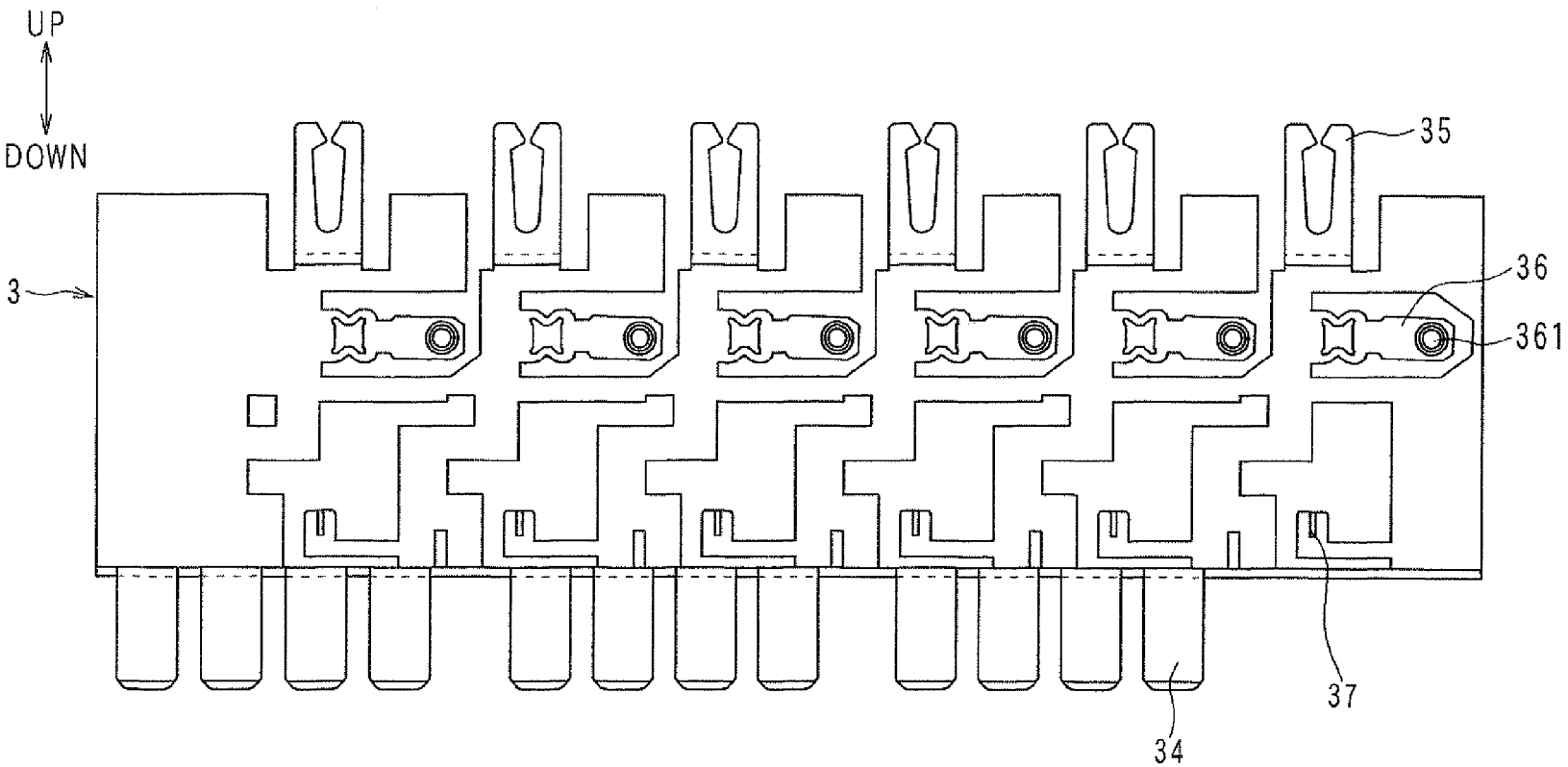
FIG. 4 is a front view illustrating a first bus bar before being resin-molded in accordance with the embodiment.
Figure 5:
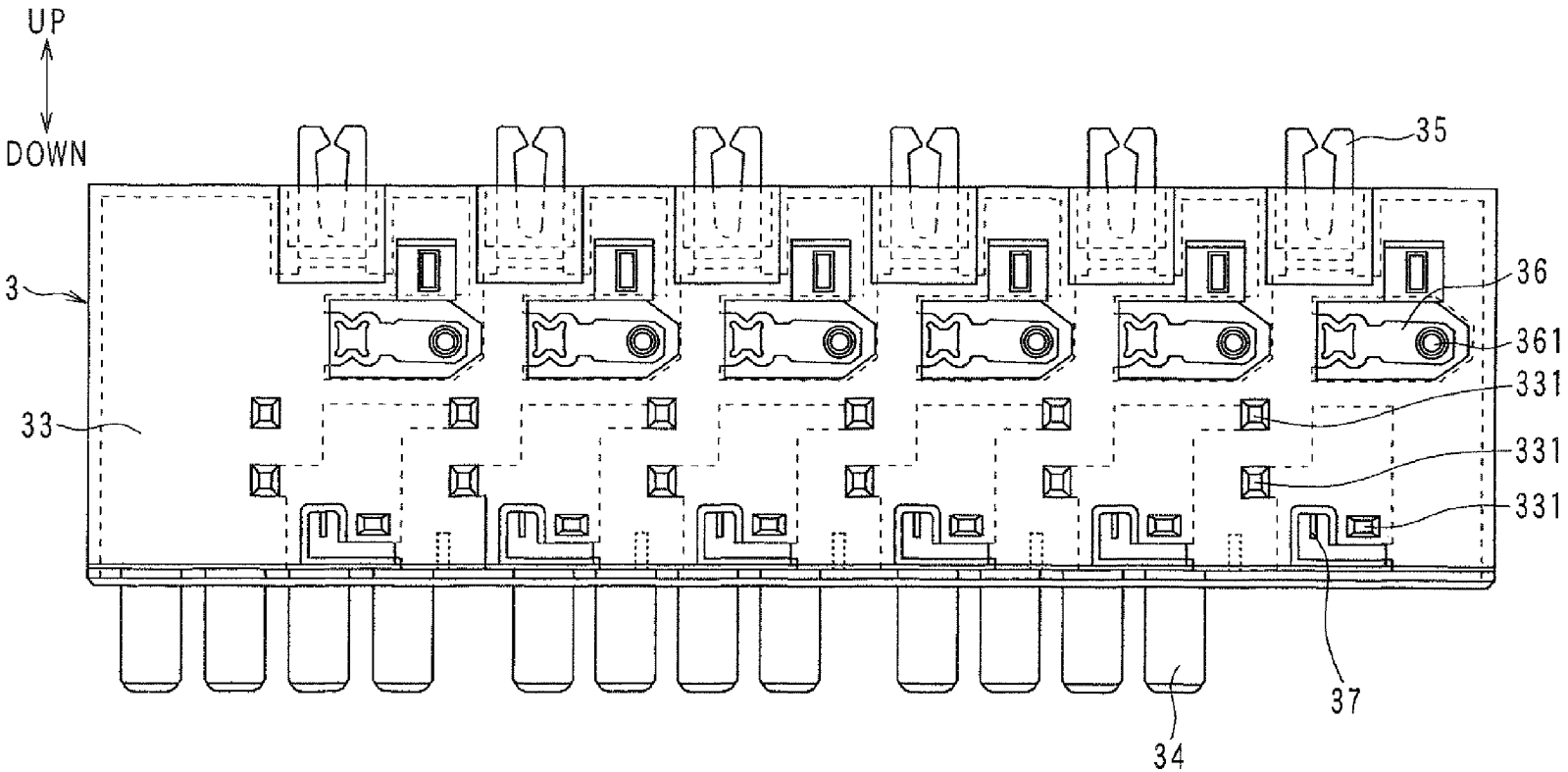
FIG. 5 is a front view illustrating the first bus bar after being resin-molded in accordance with the embodiment.
Figure 6:
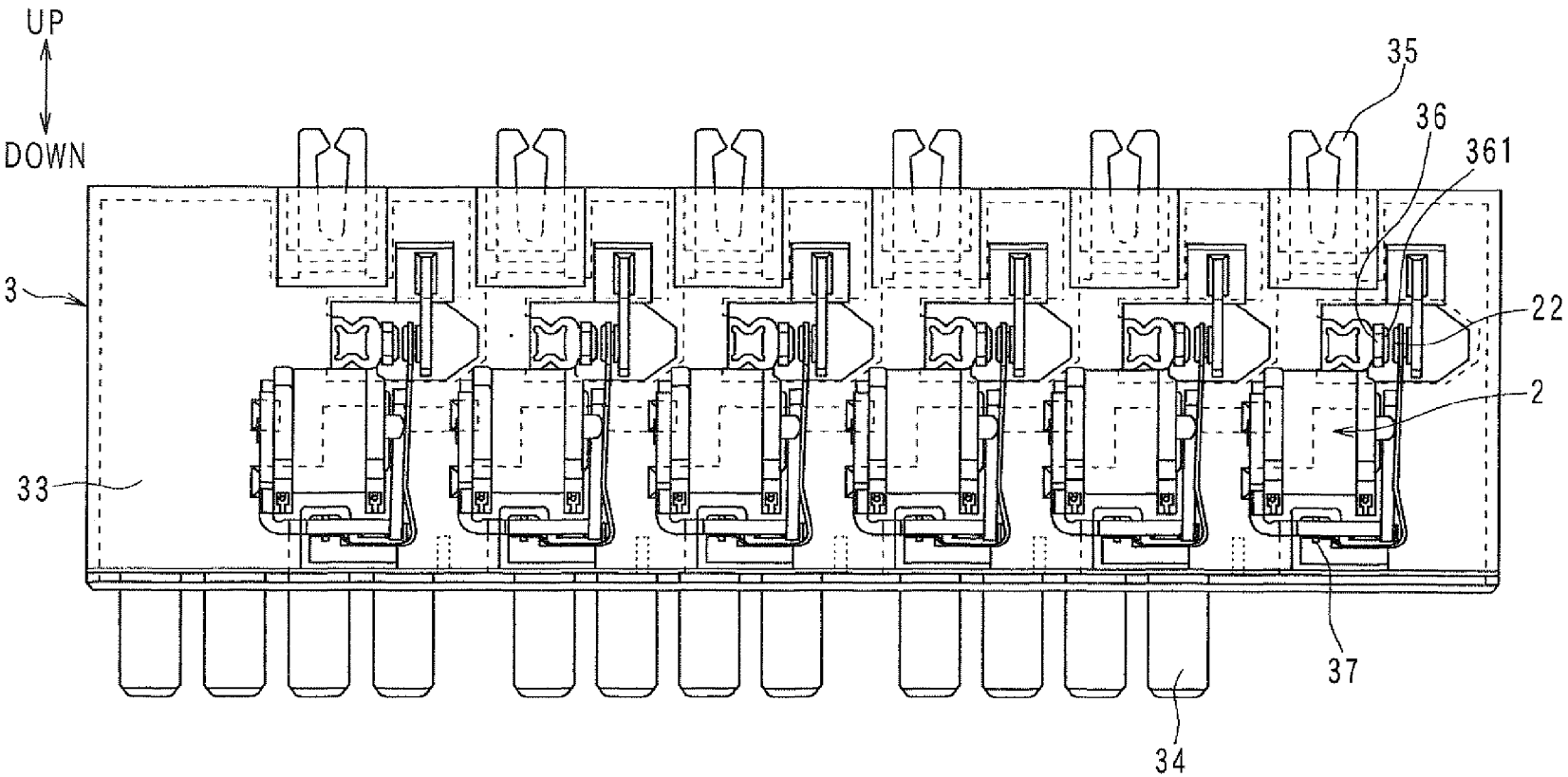
FIG. 6 is a front view illustrating the first bus bar with a mechanical relay mounted thereon in accordance with the embodiment.

Up-down arrows in FIG. 4 to FIG. 6 indicate an upward-downward (vertical) direction when the relay device 1 is installed in the vehicle.

The first bus bar 3 is formed in a shape shown in FIG. 4 by stamping. More specifically, connector terminals 34, which are connected to a load side connector terminal (i.e., connector terminal connected to the external load), are formed at an lower end of the first bus bar 3. The two-way fuse terminals 35 each of which supporting the fuse 32 therebetween are formed at an upper end of the first bus bar 3. Fixed contact terminals 36 are formed at an intermediate portion of the first bus bar 3 in the up-down direction. A fixed contact 361 which approaches and separates from the moving contact 22 of the mechanical relay 2 is formed at an end portion of the fixed contact terminal 36. Load circuit connecting terminals 37, to each of which a load terminal 23 of the mechanical relay 2 (described in greater detail hereinafter) is connected, are formed in the first bus bar 3 above the connector terminal 34 and below the fixed contact terminal 36.

After being stamped, the first bus bar 3 is resin-molded as shown in FIG. 5. More specifically, an area of the first bus bar 3 except the connector terminals 34, the fuse terminals 35, the fixed contact terminals 36, the fixed contacts 361, and the load circuit connecting terminals 37 is covered with the mold layer 33. Leg portion insertion holes 331, into each of which a leg portion 24 (described in greater detail hereinafter) of the mechanical relay 2 is press-fitted, are formed on the mold layer 33 above the connector terminal 34 and below the fixed contact terminal 36.

After being resin-molded, the first bus bar 3 is stamped again. In this stamping process, a predetermined portion of the first bus bar 3 is cut and removed so as to electrically separate the relay loading circuit 31 from the fuse terminal 35 to the fixed contact terminal 36 and the relay loading circuit 31 from the load circuit connecting terminal 37 to the connector terminal 34.

After this another stamping, as shown in FIG. 6, the fixed contact terminal 36 is bent at a right angle toward a front side of a plane of the drawing of FIG. 6. After the fixed contact terminal 36 is bent, the mechanical relay 2 is mounted on the first bus bar 3. This process is described in greater detail hereinafter.

Figure 7:
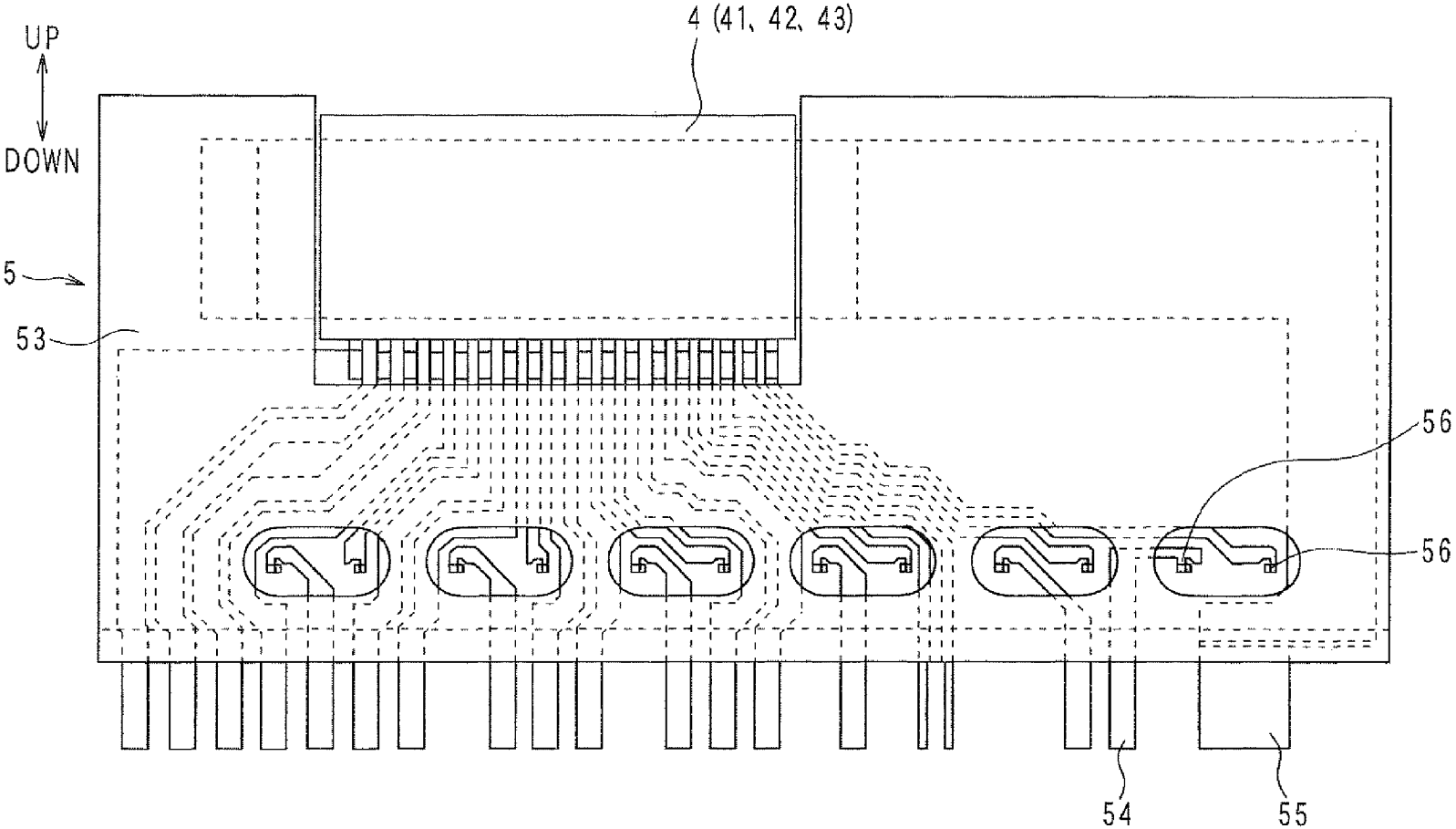
FIG. 7 is a front view illustrating a second bus bar with an intelligent module packaged thereon in accordance with the embodiment.

Up-down arrows in FIG. 7 indicate an upward-downward (vertical) direction when the relay device 1 is installed in the vehicle.

As shown in FIG. 7, connector terminals 54, which are connected to a GND side connector terminal (i.e., connector terminal connected to the ground (GND)) or the load side connector terminal, are formed at a lower end of the second bus bar 5. A connector terminal 55, which is connected to the power source side connector terminal is formed at the lower end of the second bus bar 5.

Coil circuit connecting terminals 56, to each of which a coil terminal 25 (described in greater detail hereinafter) of the mechanical relay 2 is connected, are formed on the second bus bar 5. One of a pair of coil circuit connecting terminals 56 is connected to the connector terminal 54, and the other one of the terminals 56 is connected to the first relay drive circuit 41 of the intelligent module 4.

Figure 8A:
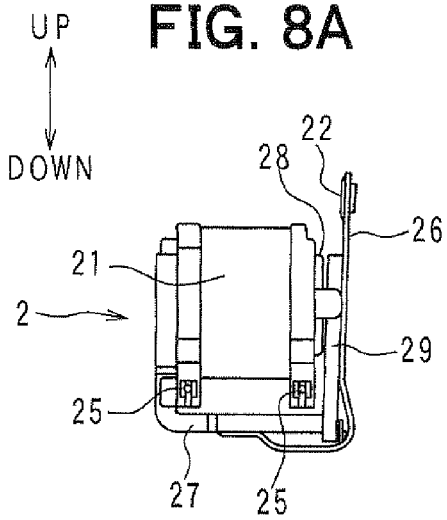
FIG. 8A is a front view illustrating the mechanical relay in accordance with the embodiment.

Up-down arrows in FIG. 8A indicate an upward-downward (vertical) direction when the relay device 1 is installed in the vehicle.

The mechanical relay 2 is configured such that a fixed contact is omitted from a usual mechanical relay. As described above, the fixed contacts 361 are formed on the first bus bar 3.

Figure 8B:
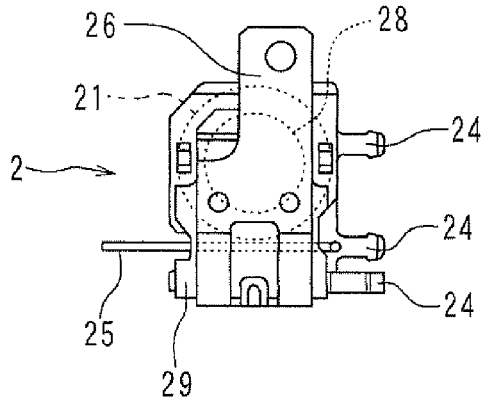
FIG. 8B is a right side view of FIG. 8A.
Figure 8C:
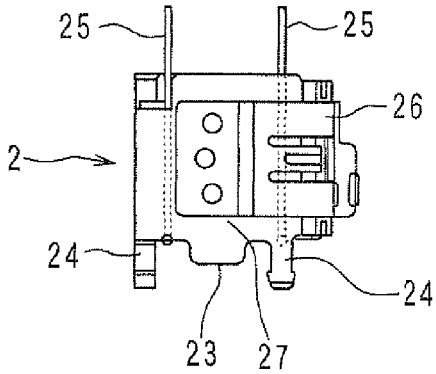
FIG. 8C is a bottom view of FIG. 8A.

In FIG. 8A to FIG. 8C, the mechanical relay 2 includes a moving contact member 26, a yoke (magnetic path member) 27 made of a soft iron plate and L-shaped when viewed from the front, a columnar fixed core (magnetic path member) 28 made of a soft iron plate and inserted in a bobbin on which the coil 21 is wound, and armature (magnetic path member) 29 made of a soft iron material like a flat plate.

The moving contact member 26 includes a fixed side portion and an oscillating side portion extending from one end of the fixed side portion perpendicular to the fixed side portion, and is formed by stamping out a phosphor bronze thin plate and then bending it at a right angle. Metal for a contact is hard-faced at the oscillating side portion of the moving contact member 26 to be formed into the moving contact 22. As shown in FIG. 6, in a state in which the mechanical relay 2 is mounted on the first bus bar 3, the moving contact 22 is opposed to the fixed contact 361 formed on the first bus bar 3.

The armature 29 is closely-attached and fixed to the oscillating side portion of the moving contact member 26 to extend along the oscillating side portion. One side of the yoke 27 formed in a shape of an L-shaped plate is fixed by caulking to the fixed side portion of the moving contact member 26. The other side of the yoke 27 extends generally parallel to the oscillating side portion and the armature 29 from an end portion of the fixed side portion of the moving contact member 26 on an opposite side from the oscillating side portion. Accordingly, the armature 29 and the other side of the yoke 27 are arranged in a shape of a U-shaped plate when viewed as a whole. The fixed core 28 passing through the coil 21 is fixed to the other side of the yoke 27 with the other side of the yoke 27 and the armature 29 magnetically short-circuited. Therefore, the yoke 27, the fixed core 28, and the armature 29 constitute a closed magnetic circuit having a gap formed in a rectangular shape with a gap between the armature 29 and the fixed core 28 when viewed as a whole. The moving contact member 26 excellent in elasticity leaves the gap.

One of the three leg portions 24 projects from one side of the yoke 27 toward the first bus bar 3, and the other two of the leg portions 24 project from the other side of the yoke 27 toward the first bus bar 3. The three leg portions 24 are press-fitted respectively into the leg portion insertion holes 331 of the mold layer 33, so that the yoke 27 is fixed to the first bus bar 3 and eventually the mechanical relay 2 is fixed on the first bus bar 3 (see FIG. 6).

The load terminal 23 projects from one side of the yoke 27 toward the first bus bar 3. After the three leg portions 24 are press-fitted respectively into the leg portion insertion holes 331, the load terminal 23 is joined to the load circuit connecting terminal 37 of the first bus bar 3 by welding or the like (see FIG. 6).

The tow coil terminals 25 are connected to both ends of the coil 21 which form a magnetic field when energized. An end portion of the coil terminal 25 extends toward the second bus bar 5 to be joined to the coil circuit connecting terminal 56 of the second bus bar 5 by micro-arc welding or the like (see FIG. 2 and FIG. 3).

In the relay device 1 having the above configuration, the first relay drive circuit 41 of the intelligent module 4 opens and closes the coil circuit 52 based on an operation signal, so that energization of the coil 21 of the mechanical relay 2 is controlled.

When the coil circuit 52 is closed and thereby the coil 21 is energized, the armature 29 and the oscillating side portion of the moving contact member 26 are attracted to the fixed core 28. Accordingly, the moving contact 22 is closely-attached on the fixed contact 361, so that the relay loading circuit 31 is closed. As a result, electric power is supplied to the external load from the power source of the vehicle via the fuse power source circuit 61 of the fuse power source bus bar 6, the fuse 32, the relay loading circuit 31 of the first bus bar 3, and the mechanical relay 2. In addition, in the mechanical relay 2, the yoke 27, the moving contact member 26, and the moving contact 22 constitute a current pathway.

When the coil circuit 52 is opened and thereby the energization of the coil 21 is stopped, magnetic force applied to the armature 29 no longer exists, so that the oscillating side portion of the moving contact member 26 returns to its original position by its elastic force. The moving contact 22 disengages from the fixed contact 361 so as to open the relay loading circuit 31. Consequently, the supply of electric power to the load is stopped.

The second relay drive circuit 43 of the intelligent module 4 controls actuation of the semiconductor relays 42 based on an operation signal. When the semiconductor relay 42 is turned into an on-state, electric power is supplied to the load from the power source of the vehicle via the semiconductor relay 42 and the semiconductor relay loading circuit 51 of the second bus bar 5.

The relay device 1 according to the present embodiment uses either the mechanical relay 2 or the semiconductor relay 42 in accordance with the use for loads. Accordingly, the relay device 1 is downsized with its reliability ensured.

Because a semiconductor relay is frequently used for a small current load, the second bus bar 5, which forms the semiconductor relay loading circuit 51, has a smaller thickness than the first bus bar 3 which forms the relay loading circuit 31. Since the coil circuit 52 is formed on the second bus bar 5 whose thickness is made smaller, the coil circuit 52 is made thicker than forming the coil circuit 52 on the first bus bar 3. Thus, a bus bar which forms the coil circuit 52 is readily processable.

According to the embodiment, since the relay device 1 includes the first bus bar 3 which forms the relay loading circuit 31 and the second bus bar 5 which forms the coil circuit 52, each bus bar has a thickness suitable for a flowing electric current, and a bus bar is easily processed by virtue of the appropriate thickness of the bus bar.

Furthermore, the load terminal 23 of the mechanical relay 2 is electrically connected to the first bus bar 3 having the relay loading circuit 31, and the coil terminal 25 of the mechanical relay 2 is electrically connected to the second bus bar 5 having the coil circuit 52. Accordingly, a tab in the conventional relay device disclosed in JP-A-2005-142256 is made unnecessary. Therefore, a space for the tab is made unnecessary, so that the relay device 1 is further downsized and a working process, in which the tab is formed, is eliminated.

When a printed board is employed, it has been necessary to produce a connector terminal separately from the printed board and to connect the connector terminal to the printed board. The connector terminal 34 is formed integrally on the first bus bar 3, and the connector terminals 54, 55 are formed integrally on the second bus bar 5. Accordingly, a connector terminal does not need to be produced separately as in the case of using a printed board, and a working process for connecting a connector terminal is eliminated.

In addition, The mechanical relays 2 and the intelligent module 4 are arranged so that the mechanical relays 2 and the intelligent module 4 do not overlap when the relay device 1 is viewed in a stacking direction of the first bus bar 3, the second bus bar 5, and the fuse power source bus bar 6. Accordingly, the increase of a size of the relay device 1 in the stacking direction of the bus bars in the relay device 1 is limited.

Also, the opening 71 for attaching and detaching the fuse 32 is formed at an upper portion of the case 7. Accordingly, the fuse 32 is easily attached and detached.

Additional advantages and modifications will readily occur to those skilled in the art. The invention in its broader terms is therefore not limited to the specific details, representative apparatus, and illustrative examples shown and described.

What is claimed is:

1. A relay device comprising:

a plurality of mechanical relays each of which includes:
- a coil;
- a moving contact, a position of which changes in accordance with whether or not the coil is energized;
- a load terminal conductive to the moving contact; and
- a coil terminal connected to the coil;

a first bus bar including a loading circuit, wherein:
- an electric current flows to an external load through the loading circuit; and
- the loading circuit is opened and closed as a result of the change of the position of the moving contact;

a second bus bar including a coil circuit through which the coil is energized; and a relay drive circuit packaged on the second bus bar and configured to open and close the coil circuit based on an operation signal, wherein:
- the first bus bar and the second bus bar are stacked at predetermined intervals;
- the plurality of mechanical relays is located between the first bus bar and the second bus bar;
- the load terminal is connected to the first bus bar; and
- the coil terminal is connected to the second bus bar.

2. The relay device according to claim 1, further comprising:

a first connector terminal formed integrally with the first bus bar; and a second connector terminal formed integrally with the second bus bar.

3. The relay device according to claim 1, wherein the plurality of mechanical relays and the relay drive circuit are arranged so as not to overlap when viewed in a stacking direction of the first bus bar and the second bus bar.

4. The relay device according to claim 1, wherein the relay device is disposed in a vehicle, the relay device further comprising:

a fuse disposed in the loading circuit of the first bus bar;

a case accommodating the plurality of mechanical relays, the relay drive circuit, the first bus bar, the second bus bar, and the fuse; and an opening formed at one end portion of the case, wherein the fuse is attached to and detached from the first bus bar through the opening.

5. A relay device comprising:

a plurality of mechanical relays each of which includes:
- a coil;
- a moving contact, a position of which changes in accordance with whether or not the coil is energized;
- a load terminal conductive to the moving contact; and
- a coil terminal connected to the coil;

a first bus bar including a relay loading circuit, wherein:
- an electric current flows to an external load through the relay loading circuit; and
- the relay loading circuit is opened and closed as a result of the change of the position of the moving contact;

a second bus bar including a semiconductor relay loading circuit and a coil circuit, the coil being energized through the coil circuit;

a plurality of semiconductor relays each of which opens and closes the semiconductor relay loading circuit, an electric current flowing to an external load through the semiconductor relay loading circuit;

a first relay drive circuit configured to open and close the coil circuit based on an operation signal; and a second relay drive circuit configured to control the plurality of semiconductor relays based on the operation signal, wherein:
- the first relay drive circuit, the plurality of semiconductor relays, and the second relay drive circuit are packaged on the second bus bar;
- the first bus bar and the second bus bar are stacked at predetermined intervals;
- the plurality of mechanical relays is located between the first bus bar and the second bus bar;
- the load terminal is connected to the first bus bar; and
- the coil terminal is connected to the second bus bar.

6. The relay device according to claim 5, further comprising:

a first connector terminal formed integrally with the first bus bar; and a second connector terminal formed integrally with the second bus bar.

7. The relay device according to claim 5, wherein:

the plurality of semiconductor relays, the first relay drive circuit, and the second relay drive circuit are integrated into an intelligent module; and the plurality of mechanical relays and the intelligent module are arranged so as not to overlap when viewed in a stacking direction of the first bus bar and the second bus bar.

8. The relay device according to claim 5, wherein the relay device is disposed in a vehicle, the relay device further comprising:

a fuse disposed in the relay loading circuit of the first bus bar;

a case accommodating the plurality of mechanical relays, the plurality of semiconductor relays, the first relay drive circuit, the second relay drive circuit, the first bus bar, the second bus bar, and the fuse; and an opening formed at one end portion of the case, wherein the fuse is attached to and detached from the first bus bar through the opening.

* * * * *